United States Patent [19]

Maloney et al.

[11] 4,079,288

[45] Mar. 14, 1978

[54] ALUMINA COATINGS FOR MERCURY VAPOR LAMPS

[75] Inventors: Kenneth M. Maloney, Pittsford, N.Y.; Robert E. Clark, Chesterland, Ohio

[73] Assignee: General Electric Company, Schenectady, N.Y.

[21] Appl. No.: 792,934

[22] Filed: May 2, 1977

Related U.S. Application Data

[63] Continuation-in-part of Ser. No. 583,961, Jun. 5, 1975, abandoned.

[51] Int. Cl.[2] ..... H01J 61/35; H01J 61/40

[52] U.S. Cl. ..... 313/489; 313/493; 313/113; 313/221

[58] Field of Search ..... 313/493, 492, 489, 113, 313/221

[56] References Cited

U.S. PATENT DOCUMENTS

| | | | |
|---|---|---|---|
| 2,864,966 | 12/1958 | Burns | 313/489 |
| 2,892,956 | 6/1959 | Vodicka | 313/489 X |
| 3,067,356 | 12/1962 | Ray | 313/221 |
| 3,541,377 | 11/1970 | Nagy | 313/489 |
| 3,617,357 | 11/1971 | Nagy | 313/489 X |
| 3,748,518 | 7/1973 | Lewis | 313/489 X |
| 3,842,306 | 10/1974 | Henderson et al. | 313/116 |
| 3,845,343 | 10/1974 | Hammer | 313/489 X |

*Primary Examiner*—Palmer C. Demeo

*Attorney, Agent, or Firm*—John F. McDevitt; Lawrence R. Kempton; Frank L. Neuhauser

[57] ABSTRACT

An improved mercury vapor lamp construction as described which includes an ultraviolet reflecting underlayer of alumina particles for the phosphor coating to enable reduction in the phosphor coating weight without accompanying reduction in the lamp lumen output. The alumina underlayer comprises spherical alumina particles that have been vapor-deposited in a certain particle size range to provide selective reflection of the ultraviolet radiation being emitted from the overlying phosphor coating. The alumina underlayer is deposited upon the interior surface of the lamp glass envelope and has been found generally useful in otherwise conventional high-pressure and low-pressure mercury vapor lamps.

9 Claims, 2 Drawing Figures

ALUMINA COATINGS FOR MERCURY VAPOR LAMPS

This application is a continuation-in-part of copending United State patent application Ser. No. 583,961, filed June 5, 1975, and now abandoned.

BACKGROUND OF THE INVENTION

Various coatings of non-luminescent particulate materials are already known to be useful when applied as an undercoating for the phosphor layer in both fluorescent-type and mercury vapor-type lamps. In both of said type lamps, the phosphor coating is disposed on the inner surface of the lamp glass envelope in receptive proximity to the ultraviolet radiation being generated by the mercury discharge. The luminous efficiency of such lamps is improved by back reflection of the incident radiation being emitted from the phosphor layer which has permitted reduction in the phosphor coating weight as well as providing color correction said to be attributable to such modified emission behavior. The prior arts reflecting coatings for this purpose are deposited from liquid coating suspensions with requirements upon the non-luminescent particulate material being negligible absorption; that is, high diffuse reflection coefficient for both visible and ultraviolet radiation, a particle size as small as and preferably smaller in size than the particle size of the phosphor coating, and a further requirement of having physical properties which do not become altered during manufacture or life of the mercury vapor lamp. A preferred non-luminescent particulate material for use in this manner is finely divided silica although other diverse materials which do not absorb either incident ultraviolet radiation or visible radiation being emitted by the phosphor include calcium pyrophosphate, barium sulfate, and alumina.

SUMMARY OF THE INVENTION

It has now been discovered by the applicants, surprisingly, that a particular form of alumina particles can be deposited directly upon the untreated internal surface of a mercury vapor lamp glass envelope as an underlayer for the phosphor coating in a mercury vapor lamp. This manner of pre-coating does not require additional processing steps and provides selective reflection of the ultraviolet radiation being emitted from the phosphor coating without producing any substantial variation in the color temperature of the visible radiation being emitted from said mercury vapor lamp. The particular alumina material being applied in this manner has previously been employed to provide a light-diffusion layer upon the surface of the glass envelope employed for electric lamps as described in U.S. Pat. No. 3,842,306, issued to Henderson et al, and assigned to the assignee of the present invention. In said prior known application, however, it was generally desired to produce a coating deposit having sufficient thickness so that the light output distribution from the coated lamp was maintained relatively uniform such as is required for hiding the filament of an incandescent lamp. In the present application it will be desirable to employ a vapor deposit alumina underlayer of a lesser thickness for selective back reflection of the ultraviolet radiation without altering the visible transmission so as not to vary the color temperature of the modified mercury vapor lamp when operated to any significant degree. In all other respects, the vapor-deposited alumina material remains the same as described in the aforementioned U.S. Pat. No. 3,842,306 and which comprises vapor-formed spherical alumina particles having an individual particle size range from approximately 400 Angstroms to 5,000 Angstroms in diameter, and with said underlayer scattering at least 99 percent of the incident visible radiation with minor lumen loss when deposited directly upon the clear internal surface of the lamp glass envelope. Consequently, the method of deposition and optical characteristics of the deposited material per se need not further be described in the present application except as pertains to the novel light emission behavior of mercury vapor lamps incorporating the present vapor deposit alumina underlayer.

BRIEF DESCRIPTION OF THE DRAWINGS

Preferred embodiments of the invention will now be described with reference to the accompanying drawings in which.

DESCRIPTION OF THE PREFERRED EMBODIMENTS

In the preferred method of forming the present vapor-deposited alumina underlayer, the coating is deposited directly upon the untreated internal surface of the lamp glass envelope prior to its assembly as a mercury vapor lamp. More particularly, such coating can be deposited by combustion of a pellet of aluminum isopropoxide or other solid aluminum alkoxide compound which is burned inside the bulb utilizing an amount of the starting material dependent upon the coating weight desired. Said coating method is described in the previously referenced U.S. Pat. No. 3,842,306. In the preferred process, rapid combustion of the solid aluminum isopropoxide pellet is promoted by igniting the pellet in a burner which surrounds the pellet with a moving oxygen stream while said burner is disposed inside the lamp glass envelope. The overlying phosphor layer can then be applied directly to the exposed surface of the alumina underlayer utilizing conventional methods of application from a liquid suspension of the phosphor particles and without any need for post treatment of the alumina underlayer after deposition. A single lehring of the phosphor coating overlying the vapor-deposited alumina underlayer can then be carried out in further conventional fashion to provide the improved lamp emission characteristics reported in more detail below.

Figure 1:
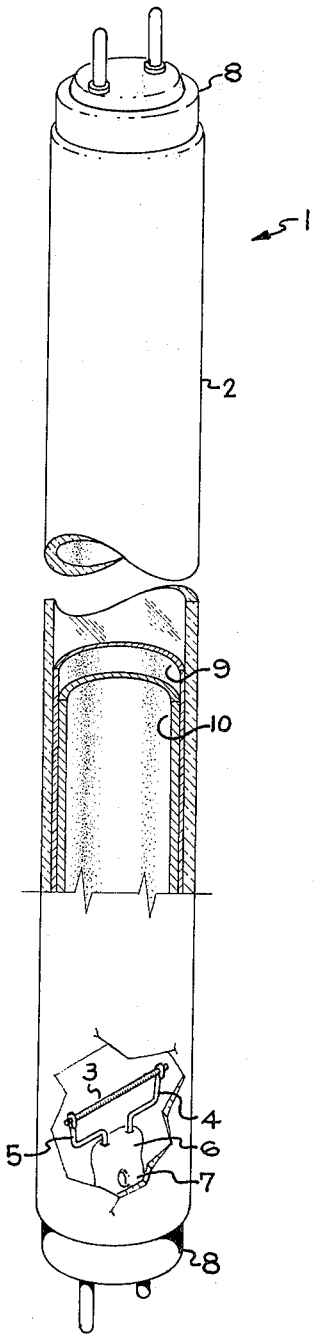
FIG. 1 is a broken-away perspective view of a fluorescent lamp construction having the present alumina undercoating.

Referring to FIG. 1, there is shown a fluorescent lamp 1 comprising an elongated soda-lime silicate soft glass bulb 2 with a circular cross section. The discharge assembly in said lamp is the usual electrode structure 3 at each end supported on in-lead wires 4 and 5 which extend through a glass press seal 6 in a mount stem 7 to the contacts of a base 8 affixed at opposite ends of the lamp. The discharge-sustaining filling in the sealed glass tube is an inert gas such as argon or a mixture of argon and other gases at a low pressure in combination with a small quantity of mercury to provide the low vapor pressure manner of lamp operation. The inner surface of the glass bulb is provided with an ultraviolet radiation reflecting vapor-deposited alumina underlayer 9 as previously described and a phosphor coating 10 is applied with both coatings extending substantially the full length of the bulb and around the bulb circumferential inner wall.

To better illustrate the improvment in light output characteristics obtained for a fluorescent lamp having the above type construction, a number of F13T8 size lamps were fabricated utilizing various phosphor weight coatings in combination with various weight vapor-deposited alumina underlayers obtained by varying the pellet weight of aluminum isopropoxide. The lumen output for said lamps along with the corresponding maintenance values are reported in Table I below:

Table I

| Pellet Weight | Sample | Phosphor wt. reduction % | Lumen Output 0 hr. | 100 hr. | %Drop |
|---|---|---|---|---|---|
| 0.8 | | | | | |
| | A | 10 | 589 | 550 | 6.6 |
| | B | 20 | 593 | 558 | 5.9 |
| (none) | C | — | 603 | 558 | 7.5 |
| | D | 30 | 593 | 545 | 8.1 |
| | E | 40 | 598 | 553 | 7.5 |
| | F | 50 | 568 | 528 | 7.1 |
| 1.6 | | | | | |
| | G | 10 | 609 | 554 | 9.0 |
| | H | 20 | 615 | 549 | 10.7 |
| | I | 30 | 605 | 555 | 8.3 |
| | J | 40 | 599 | 540 | 9.8 |
| | K | 50 | 570 | 521 | 9.6 |
| 2.4 | | | | | |
| | L | 10 | 602 | 541 | 11.7 |
| | M | 20 | 615 | 563 | 10.6 |
| | N | 30 | 594 | 531 | 10.6 |
| | O | 40 | 622 | 569 | 8.5 |
| | P | 50 | 589 | 525 | 10.9 |

It can be seen from the above results that a 2.4 gram pellet weight pre-coating produced the greatest improvement in initial light output for said lamp but was accompanied by lowest maintenance. It can be further noted from said results that a 0.8 and 1.6 gram pellet weight pre-coating produced better maintenance at a 20 percent reduction in the phosphor coating weight. The specific phosphor material employed to produce these results was a conventional cool-white calcium halophosphate phosphor activated with manganese and antimony which was applied as a suspension in a water-soluble binder.

Figure 2:
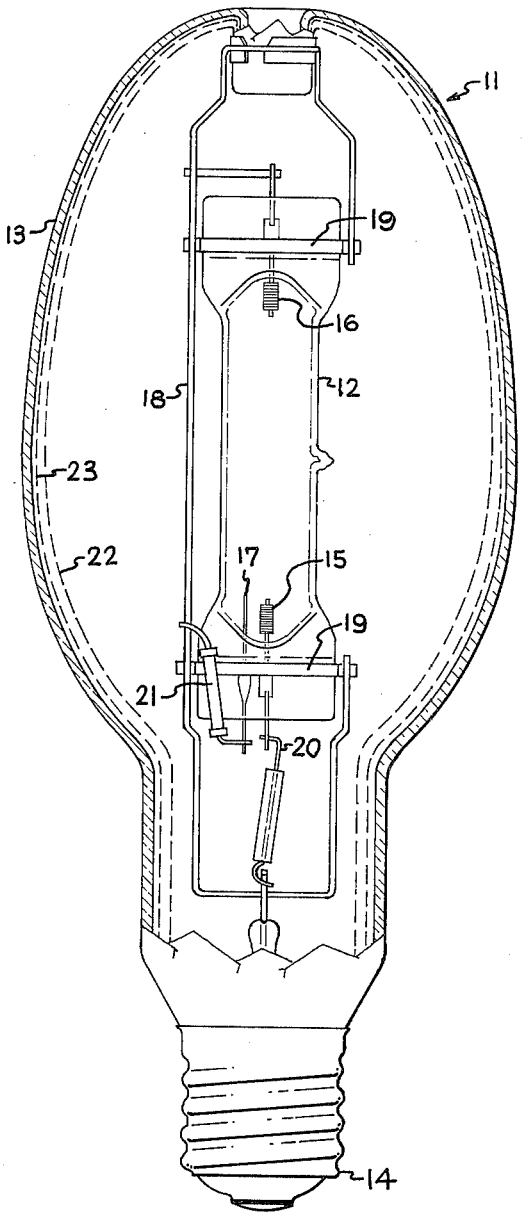
FIG. 2 shows a high-pressure mercury vapor discharge lamp containing the same alumina undercoating in accordance with the present invention.

Referring to FIG. 2, there is shown a high-pressure mercury vapor lamp 11 comprising a quartz arc tube 12 enclosed within a vitreous outer jacket or lamp glass envelope 13 provided with a screw base 14. Other kinds of high-pressure mercury vapor lamps use different gas or vapor fillings within the arc tube, for instance, vaporizable metal halides such as sodium, thallium and indium iodides, in addition to the mercury and inert starting gas. The lamp glass envelope 13 can be made of a soft glass such as soda-lime glass and preferably of a conventional hard glass, such as borosilicate glass which may further contain lead. Arc tube 12 is provided with main electrodes 15 and 16 at each end with an auxiliary electrode 17 being located adjacent to the main electrode 15. The discharge-sustaining filling in said arc tube comprises a measured amount of mercury which is completely vaporized during operation in combination with an inert starting gas such as argon, all of which is conventional in such lamps. The arc tube is supported within the outer jacket by a frame or harp comprising a single side rod 18 and metal strap 19. The frame also serves as a conductor between electrode 16 and the base shell. Another conductor 20 connects the other electrode 15 to the center contact of the base. Starting electrode 17 is connected to main electrode 16 at the opposite end of the arc tube by a current limiting resistor 21 in already known fashion. A conventional phosphor coating 22 is applied over the vapor-deposited alumina reflector underlayer 23 all as previously described.

The above modified high-pressure mercury vapor lamp is a good emitter of ultraviolet radiation, especially at a wavelength of 3,650 Angstroms. The red deficiency and color rendition of such lamps are much improved by coating the inside of the outer envelope with a red emitting phosphor excited by the ultraviolet radiation being generated from the mercury arc. Red emitting phosphors commonly used in such lamps are tin-activated strontium orthophosphate, and manganese-activated magnesium fluorogermanate. More recently, europium-activated yttrium vanadate and europium-activated yttrium vanadate phosphate phosphors (T. W. Luscher and R. K. Datta, *Illuminating Engineering*, Vol. 65, No. 1, Jan. 1970, pgs. 49–53) have found extensive use in the above type high-pressure mercury vapor lamps. These phosphors emit in the red portion (about 600–650 nanometers) of the color spectrum thus producing color-corrected visible emission from the lamp.

To further provide a more detailed understanding of the improvement in lamp emission behavior from the above type modified lamp construction along with a potential for reducing the phosphor coating weight to achieve a desired color temperature in accordance with the present invention, various 175-watt size lamps were fabricated. The phosphor coating weights were varied in said lamps along with the thickness of the vapor-deposited alumina underlayer. The lumen output for said lamps are reported in Table II below along with the $x$ and $y$ values measured in accordance with the recognized I.C.I. chromaticity system for these measurements.

Table II

| Pellet Wt. (gm.) | Phosphor Coating Reflectance | Lumen Output Lumens/Watt | Emission Color x | y |
|---|---|---|---|---|
| 0.2 | 35 | 50.7 | .394 | .376 |
| 0.2 | 40 | 52.6 | .394 | .373 |
| 0.2 | 45 | 50.1 | .394 | .374 |
| 0.3 | 35 | 50.4 | .394 | .376 |
| 0.3 | 40 | 51.7 | .392 | .376 |
| 0.3 | 45 | 50.8 | .400 | .377 |
| 0.3 | 50 | 48.7 | .394 | .379 |
| 0.6 | 35 | 51.9 | .393 | .377 |
| 0.6 | 40 | 50.0 | .392 | .378 |
| 0.6 | 45 | 48.7 | .395 | .380 |

It can be noted from the above results that reduced phosphor coating weights as represented by lower reflectance values in said table does not result in significant lowering of the lamp light output. Additionally, it can be noted that the emission color temperatures of the coated lamps as represented by the $x$ and $y$ values in the table remain substantially the same with variation in the coating weight of the vapor-deposited alumina underlayer. The $x$ and $y$ chromaticity values obtained when said lamp construction was coated to a 43 reflectance value with the same europium-activated yttrium vanadate phosphate phosphor but without the vapor-deposited alumina underlayer were found to be in the range 0.380 – 0.392 and 0.372 – 0.380, respectively, which further indicates no substantial shift in color temperature from practice of the present invention.

While a complete understanding of the exact manner in which the above described vapor-deposited alumina underlayer provides improved emission behavior for mercury vapor lamps is not known, it is believed attributable to increased scattering power wherein said layer scatters at least 99 percent of the incident visible radiation with minor lumen loss. In so doing, a thin layer of the alumina deposit is desirable to provide selective back reflection of the ultraviolet radiation while permitting transmission of incident visible radiation being emitted from the overlying phosphor layer. Excessive thickness of the vapor-deposited alumina underlayer is undesirable since light diffusion increases with coating thickness which can lead to lower light output of the final lamp from a reduction in the visible transmission.

It will be apparent from the foregoing description that a generally useful improved alumina undercoating has been provided for mercury vapor lamps. It will be apparent that modifications can be made in the preferred method above described for depositing said coating without departing from the true spirit and scope of this invention. For example, comparable vapor-deposited alumina coatings can be obtained by direct combustion of certain liquid aluminum alkoxide compounds. Additionally, it is within contemplation to employ still further coatings for various purposes to the already coated lamps as above described. Consequently, it is intended to limit the present invention only by the scope of the appended claims.

What we claim as new and desire to secure by Letters Patent of the United States is:

1. In a mercury vapor lamp having a discharge assembly and phosphor coating enclosed within an elongated lamp glass envelope of conventional soft or hard glass, the improvement which comprises an ultraviolet reflecting underlayer for the phosphor coating of vapor-formed spherical alumina particles having an individual particle size range from approximately 400 Angstroms to 5,000 Angstroms, in diameter, said layer scattering at least 99 percent of the incident visible radiation with minor lumen loss when deposited directly upon the clear internal surface of the lamp glass envelope at a thickness providing selective ultraviolet reflection without reducing visible transmission.

2. A mercury vapor lamp as in claim 1 wherein the discharge assembly comprises an inner arc tube containing a filling of mercury and inert gas disposed within the lamp glass envelope.

3. A mercury vapor lamp as in claim 2 wherein the inner arc tube contains a vaporizable metal halide in addition to the mercury and inert gas.

4. A mercury vapor lamp as in claim 2 wherein the lamp glass envelope is made of borosilicate glass.

5. A mercury vapor lamp as in claim 2 wherein the arc tube contains a pair of spaced apart principal electrodes and an auxiliary electrode disposed adjacent one of said principal electrodes.

6. A mercury vapor lamp as in claim 1 wherein the lamp glass envelope comprises an elongated tube having electrodes at each end thereof and a halophosphate phosphor layer overlying the alumina underlayer.

7. A mercury vapor lamp as in claim 1 wherein the alumina underlayer has a thickness providing selective ultraviolet reflection without reducing visible transmission.

8. A mercury vapor lamp as in claim 1 wherein the weight of the phosphor coating has been reduced without accompanying reduction in lamp lumen output.

9. A mercury vapor lamp as in claim 8 wherein the color temperature has remained substantially the same.

* * * * *